US009872562B2

(12) United States Patent
Brunner

(10) Patent No.: US 9,872,562 B2
(45) Date of Patent: Jan. 23, 2018

(54) CABINET

(71) Applicant: KETER PLASTIC LTD., Herzlyia (IL)

(72) Inventor: Yaron Brunner, Timrat (IL)

(73) Assignee: KETER PLASTIC LTD., Herzelyia (IL)

( * ) Notice: Subject to any disclaimer, the term of this patent is extended or adjusted under 35 U.S.C. 154(b) by 0 days.

(21) Appl. No.: 14/766,115

(22) PCT Filed: Feb. 5, 2014

(86) PCT No.: PCT/IL2014/050128

§ 371 (c)(1),
(2) Date: Aug. 5, 2015

(87) PCT Pub. No.: WO2014/122650

PCT Pub. Date: Aug. 14, 2014

(65) Prior Publication Data

US 2016/0000221 A1 Jan. 7, 2016

Related U.S. Application Data

(60) Provisional application No. 61/760,748, filed on Feb. 5, 2013.

(51) Int. Cl.
*A47B 95/00* (2006.01)
*A47B 57/10* (2006.01)
(Continued)

(52) U.S. Cl.
CPC ..... *A47B 57/10* (2013.01); *A47B 31/00* (2013.01); *A47B 55/00* (2013.01); *A47B 96/06* (2013.01); *E06B 3/367* (2013.01)

(58) Field of Classification Search
CPC . A47B 57/10; A47B 96/06; A47B 2210/0043; A47B 2210/0059; A47B 31/00; A47B 55/00; A47L 15/507; E06B 3/367
(Continued)

(56) References Cited

U.S. PATENT DOCUMENTS 455,883 A * 7/1891 Merritt ..... A47K 11/04 312/310
484,121 A * 10/1892 Stein ..... A47B 49/004 126/340
(Continued)

FOREIGN PATENT DOCUMENTS

EP 1974632 10/2008
KR 20110011807 2/2011
(Continued)

OTHER PUBLICATIONS globalindustrial.com; "All-Welded 14 Gauge Bin Cabinets" 4 pages; retrieved Jan. 3, 2016. *All-Welded 14 Gauge Bin Cabinets* http://www.globalindustrial.com/g/storage/bins-totes-containers/cabinets/security-bin-cabinetes-60-wide.
(Continued)

*Primary Examiner* — Hanh V Tran
(74) *Attorney, Agent, or Firm* — Dorsey & Whitney LLP

(57) ABSTRACT

This application is directed to a cabinet configured with at least a right side wall and a left side wall, defining together a cabinet space, closeable by a at least one front door pivotally articulated at a front portion of the cabinet and displaceable between a closed position and at least a first open position. At the first open position each of the at least one door is coplanar with a respective side wall and at least one of the right side wall and the left side wall are configured with wall rail segments. One or more of the respective at least one front door is configured with door rail segments, such that the wall rail segments are coextensive with respec-
(Continued)

tive door rail segments, with a sliding gap extending between neighboring ends of a wall rail segment and a door rail segment, and defining together one or more sliding planes. The planes are configured for slidingly supporting a support unit mountable thereon.

12 Claims, 13 Drawing Sheets

(51) Int. Cl.
*A47B 31/00* (2006.01)
*A47B 55/00* (2006.01)
*A47B 96/06* (2006.01)
*E06B 3/36* (2006.01)

(58) Field of Classification Search
USPC ..... 312/311, 321.5, 317.1, 317.2, 324
See application file for complete search history.

(56) References Cited

U.S. PATENT DOCUMENTS

| | | | | | |
|---|---|---|---|---|---|
| 918,297 | A | | 4/1909 | Duffy | |
| 2,341,434 | A | * | 2/1944 | Forbes | A47B 51/00 211/121 |
| 2,431,830 | A | * | 12/1947 | Rose | H04N 5/65 312/311 |
| 2,441,728 | A | * | 5/1948 | Stanitz | A47B 77/10 312/311 |
| 3,058,320 | A | * | 10/1962 | Foster | F25D 25/00 186/54 |
| 3,135,570 | A | | 6/1964 | Erismann | |
| 3,326,203 | A | | 6/1967 | Goertzel | |
| 3,712,697 | A | * | 1/1973 | Kelley | E06B 9/115 312/240 |
| 4,590,709 | A | * | 5/1986 | Katsman | H02B 1/38 312/276 |
| 5,011,240 | A | * | 4/1991 | Kelley | A47B 31/00 312/249.12 |
| 5,026,130 | A | | 6/1991 | Wright et al. | |
| 5,048,902 | A | * | 9/1991 | Daly | B62B 3/006 312/249.8 |
| D322,875 | S | * | 12/1991 | Kelley | D34/19 |
| 5,145,245 | A | | 9/1992 | Fierthaler | |
| 5,673,984 | A | * | 10/1997 | Insalaco | A47B 47/02 312/108 |
| 6,068,356 | A | * | 5/2000 | Giuseppe | A47B 31/00 280/47.35 |
| 6,164,738 | A | * | 12/2000 | Dane | A61B 19/0264 312/213 |
| 8,201,900 | B2 | | 6/2012 | Backhaus et al. | |
| 2006/0175945 | A1 | * | 8/2006 | Deguchi | A47B 47/0075 312/257.1 |
| 2010/0052276 | A1 | * | 3/2010 | Brunner | B25H 3/027 280/47.35 |
| 2011/0279956 | A1 | * | 11/2011 | Sun | H05K 7/1489 361/679.02 |
| 2012/0086319 | A1 | * | 4/2012 | Sun | H05K 7/1489 312/324 |
| 2013/0134850 | A1 | * | 5/2013 | Berkowitz | A47B 88/14 312/317.1 |

FOREIGN PATENT DOCUMENTS

| | | |
|---|---|---|
| WO | WO9945221 | 9/1999 |
| WO | WO0191610 | 12/2001 |

OTHER PUBLICATIONS

Author Unknown; Smartlink Modular Storage; 1 page; available as of Jan. 3, 2016.

ovisonline.com; Cabinet Hardware; 1 page; available as of Jan. 3, 2016. https://www.pinterest.com/pin/60024607504381534/.

Kenmore; The Tilt 'N Take freezer drawer; 1 page; available as of Jan. 3, 2016.

Eucck; Sun-MC9 Cabinet with 8 shelves/8 door trays/2 doors; 3 pages; available as of Jan. 3, 2016. http://www.tradekorea.com/product/detail/P272322/__EUCCK__Sun__MC9__Cabinet__with__8__shelves__8__door__trays__2__doors.html.

Gilmore-Kramer; Model DU—Deep Pocket Door—Bin & Shelf Cabinet; 3 pages; available as of Jan. 3, 2016. http://www.gilmorekramer.com/more__info/4__inch__deep__door__cabinets__with__plastic__bins__and__or__shelves/4__inch__deep__door__cabinets__with__plastic__bins__and__or__shelves.shtml.

FSI Industires; Model DZ—Plastic Bin Welded Cabinet—Solid Doors; 4 pages; available as of Jan. 3, 2016. http://www.fsindustries.com/more__info/plastic__bin__&__shelf__cabinets/plastic__bin__&__shelf__cabinets.shtml.

US Groove; Inter-Lok: Modular Garage Storage Cabinets and Systems; 4 pages; available as of Jan. 3, 2016. http://usgroove.com/inter-lok-modular-garage-storage-cabinets-and-systems/.

Vauth-Sagel; Storage roon solutions for kitchens, baths and living rooms; 1 page; available as of Jan. 3, 2016.

International Search Report and Written Opinion from International Application No. PCT/IL2014/050128 dated May 20, 2014.

* cited by examiner

CABINET

TECHNOLOGICAL FIELD

The present disclosed subject matter is concerned with cabinets of the type configured with retractable one or more support units.

Hereinafter in the specification and claims the term cabinet is used in its broad sense including any structure or piece of furniture with shelves, drawers, etc., configured for holding or displaying items indoors or outdoors, e.g. a utility cabinet, a refrigerator, cupboard, a closable shelving system, a niche cabinet (stand alone or built in), etc.

The term support unit is used to designate any fixed or retractable/removable support unit, such as a drawer, a basket, a bucket shelf, a shelf, etc., used for holding or displaying items.

BACKGROUND ART

References considered to be relevant as background to the presently disclosed subject matter are listed below:

US2012/086319

US2011/279956

WO0191610

Acknowledgement of the above references herein is not to be inferred as meaning that these are in any way relevant to the patentability of the presently disclosed subject matter.

BACKGROUND

US2012086319 is directed to a cabinet including a housing, two first rails, two pairs of pivoting elements, and two second rails. The housing includes two doors pivotably mounted to opposite sides of a front end of the housing. The first rails are respectively fixed to opposite internal sides of the housing. First ends of a pair of pivoting elements are pivotably connected to an inner side of each of the doors, and second ends of the pair of pivoting elements of each of the doors are pivotably connected a corresponding one of the second rails. When the doors are opened parallel to the first rails, the second rails are operable to move relative to the corresponding doors and aligned with the corresponding first rails to form two extended sliding rails.

US2011279956 is directed to a server cabinet including a cabinet, a first slide rail, and a second slide rail. The cabinet includes a top surface, a bottom surface, a rear wall, two sidewalls, and two doors. The first slide rail is mounted on an inner surface of one of the sidewalls. The first slide rail has a first end and an opposite second end. The first slide rail defines a first slide groove. The first end is adjacent to the doors, and the second end is close to the rear wall. The second slide rail has a first and a second connection ends. The second slide rail defines a second slide groove. The first connection end is rotatably coupled to the first end so that the second slide rail is capable of rotating relative to the first slide rail to a position where the second slide rail aligns with the first slide rail.

WO0191610 relates to a workstation container that comprises a cabinet body that can be opened and closed and that is provided with casters. The body is composed of a frame on which a shell is mounted on each side. Said shells consist of a substantially planar surface with a periphery that determines the shell depth. The shells substantially correspond in size to the opening of the frame. At least one of the shells is articulated on the frame and can be pivoted like a door leaf.

GENERAL DESCRIPTION

According to the present disclosed subject matter there is provided a cabinet configured with at least a right side wall and a left side wall, defining together a cabinet space, closeable by a at least one front door pivotally articulated at a front portion of the cabinet and displaceable between a closed position and at least a first open position, wherein at said first open position each of the at least one door is coplanar with a respective side wall and wherein at least one of the right side wall and the left side wall are configured with wall rail segments, and wherein one or more of the respective at least one front door is configured with door rail segments, such that the wall rail segments are coextensive with respective door rail segments, with a sliding gap extending between neighboring ends of a wall rail segment and a door rail segment, and defining together one or more sliding planes, each configured for slidingly supporting a support unit mountable thereon.

According to the present disclosed subject matter there is provided a cabinet configured with a right side wall and a left side wall, a top wall, a bottom wall and a back wall, defining together a cabinet space, closeable by a at least one front door pivotally articulated at a front portion of the cabinet and displaceable between a closed position and at least a first open position, wherein at said first open position each of the at least one door is coplanar with a respective side wall and wherein at least one of the right side wall and the left side wall are configured with wall rail segments, and wherein one or more of the respective at least one front door is configured with door rail segments, such that the wall rail segments are coextensive with respective door rail segments, with a sliding gap extending between neighboring ends of a wall rail segment and a door rail segment, and defining together one or more sliding planes, each configured for slidingly supporting a support unit mounted thereon.

According to an example of the disclosed subject matter, the support unit is provided with a runner or at least three rail engaging members at least at its one side, the runner or the at least three rail engaging members being receivable in the respective rail segment in a sliding engagement.

According to another example the support unit is provided with a latching mechanism for latching the support unit within the rail segment so as to prevent movement of the support unit within the rail segment.

According to a particular configuration a right side wall and a left side wall of each support unit is configured with at least three rail engaging members, wherein at least two rail engaging members remain engaged with rail segments upon displacement of a support unit.

According to yet a particular example, the cabinet comprises at least two doors, configured for pivotal displacement with respect to one another between a closed position and an open position, wherein at the open position the doors are substantially parallel to one another and coplanar with side walls of the cabinet.

The support units are displaceable between a fully retracted position, wherein they are fully received within the cabinet space, and an extracted position wherein they are completely out of the cabinet space, however supported between the front doors. At the fully retracted position three rail engaging members at each side of the support unit bear over the respective wall rail segments of the sliding plane; at the extracted position the three rail engaging members at each side of the support unit bear over the respective door rail segments of said sliding plane; at a first extracting sequence of drawing a support unit, a front rail engaging member extends at the sliding gap and at least two rail engaging members at each side of the support unit bear over the respective wall rail segments of the sliding plane, such that loads are born by both top and bottom wall rail segments; at a first intermediate extracting sequence of drawing a support unit, a front rail engaging member extends at the door rail segment and at least one rail engaging member at each side of the support unit extends at the wall rail segments of the sliding plane, such that loads are born substantially by bottom wall rail segments and door rail segments, at this position a typically a central rail engaging member extends at the sliding gap; at a second intermediate extracting sequence of drawing a support unit, a rear rail engaging member extends at the sliding gap and at least two rail engaging members at each side of the support unit bear over the respective door rail segments of the sliding plane, such that loads are born by both top and bottom door rail segments; upon further extracting the support unit to a position where a front rail engaging member extends out of the rail segments, at least two rear rail engaging members at each side of the support unit bear over the respective door rail segments of the sliding plane, such that loads are born by both top and bottom wall rail segments.

By indicating that loads are born by both top and bottom wall rail segments it is suggested that a moment is applied over the support unit, resulting in transferring loads at points of contact of the rail engaging members with the respective top and bottom wall rail segments.

According to a particular arrangement, the wall rail segments and the door rail segments are parallely disposed at a substantially equi-distanced configuration, wherein the rail engaging members are supported between a top rail segment and a bottom rail segment depending on displacement location of a support unit.

A sliding plane is configured such that the rail engaging members are disposed between a top rail segment and a bottom rail segment respectively.

The rail engaging members can be slidingly engaged by the top rail segments and bottom rail segments. Alternatively, the rail engaging members are merely slidingly disposed between the respective top rail segments and bottom rail segments.

In order to eliminate or at least substantially reduce trembling of the support units as they slidingly displace over the gap between the wall rail segments and the door rail segments, the rail engaging members are configured for snug sliding/rolling engagement between respective top and bottom rail segments, i.e. with substantially no axial freedom of the rail engaging members between the supporting top and bottom rail segments (i.e. in the vertical direction).

The doors can be further pivotal into so-called wide-open positions, namely non-coplanar positions with respect to the respective side walls, disposed angular positions greater than 90° or even 180°. At the wide open positions the support units are restrictedly slidable only about a respective portion of the wall rail segments.

Any one or more of the following properties, designs, features and configurations can be associated with the cabinet subject of the presently disclosed subject matter, separately or in combinations:

- The wall rail segments and the door rail segments are integrally formed with the respective side walls and the front doors;
- All wall rail segments and the door rail segments are parallel to one another;
- All wall rail segments and the door rail segments are substantially horizontal;
- Each of the doors is configured with a floor engaging support;
- The floor engaging support is configured for rolling over a floor surface about an arced path;
- The floor engaging support is configured near or at an innermost location of each door;
- The floor engaging support is a caster/swivel wheel;
- A front edge of the bottom wall is configured with a recess for receiving the floor engaging support of the doors at their closed position;
- The cabinet, and at least the right and left side walls and the front doors, can be made of injection molded plastic material;
- At the closed position, the front doors extend substantially flush with a front edge of the side walls and bottom wall of the cabinet;
- At least a portion of the cabinet can be a niche cabinet. According to such embodiments, any one or more of the right side wall, left side wall, top wall, bottom wall and back wall, or portions thereof, can be a portion of a neighboring piece of furniture, structure such as construction wall, ceiling or floor, which together with other portions of the cabinet, define the cabinet space;
- A bottom edge of the front walls is spaced from a bottom edge of the cabinet;
- The cabinet can be configured with a locomoting system. According to one example, the locomoting system comprises a rear wheeling system disposed at or near a rear portion of the cabinet, and a manipulating mechanism for tilting and wheeling the cabinet over the rear wheeling system;
- The rail engaging members can be wheels, rollers or any friction reducing element facilitating stabilized support yet smooth displacement of a support unit over the rail segments;
- The rail engaging members can be made of or configured with a resilient material for smooth and silenced displacement between the supporting top and bottom rail segments;
- The support units can be fully withdrawn from the cabinet and removed upon disengagement from the rail segments;
- The support units can be shelves, baskets, drawers and the like. The cabinet can accommodate an assortment of interchangeable such support units;
- The support units can assume different heights, i.e. extend between two neighboring sliding planes, or have an increased height (composed of multiplications of the distance between two neighboring sliding planes; i.e. extending over two or more sliding planes);
- The support units can be configured with the rail segments at one side of the support unit and be configured to hold the loads. It will be appreciated that to bear the desired loads, such a support unit should be either relatively narrow or should be made of a sturdy material so as not to tip over when bearing loads;
- The support unit can be a tool rack configured with the rail segment at its one side and with openings/holding members on its other side;
- The rail segments can have a T-like section, with a leg portion thereof extending substantially normal from the respective side wall or door;
- One or both of the front doors can be uniform along the entire length of the cabinet, or be split into two or more door sections. Where the doors are sectioned, there can be configured an articulation mechanism for selective engaging a top door section to a bottom door section;

The cabinet can comprise two or more doors, however where two opposing doors extending from side walls of the cabinet are configured with door rail segments such that at the open position they coextend the sliding planes defined by the rail segments;

A single rail segment can have a top surface serving as a bottom rail segment of one sliding plane, and a bottom surface serving as a top rail segment of another sliding plane extending below said one sliding plane;

The cabinet can comprise one or more sections configured with rail segments and respective sliding support units, with other sections of the cabinet configured without such rail segments and respective sliding support units. Furthermore, the cabinet can be configured with partitions dividing the cabinet into different segments with different support unit configurations;

According to another configuration, the support units can extend between one side wall and respective door unit of the cabinet, and a fixed partition wall of the cabinet, wherein the fixed partition wall is fitted with an optional telescopic rails are configured for supporting the different support units;

The cabinet can extend adjacent a fixed structure, e.g. a wall or other piece of furniture, wherein one side of the different support units is supported by door rail segments and an opposite side thereof is supported by a rail segment associated with said fixed structure.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which:

FIGS. 10A to 10E illustrate another example of a cabinet according to the present disclosure, wherein:

FIG. 10A illustrates the cabinet with only one door open and with some of the support units withdrawn;

FIG. 10B is the same as FIG. 10A, however with the left door removed for sake of clarity;

FIG. 10C is a front, left side perspective view of the cabinet, with both doors open;

FIG. 10D is a front, right side perspective view of the cabinet, with both doors open; and FIG. 10E is an enlargement of the portion marked E in FIG. 10B.

DETAILED DESCRIPTION OF EMBODIMENTS

Attention is made to the attached drawings, illustrating different cabinets and support units according to the present disclosure.

Figure 1A:
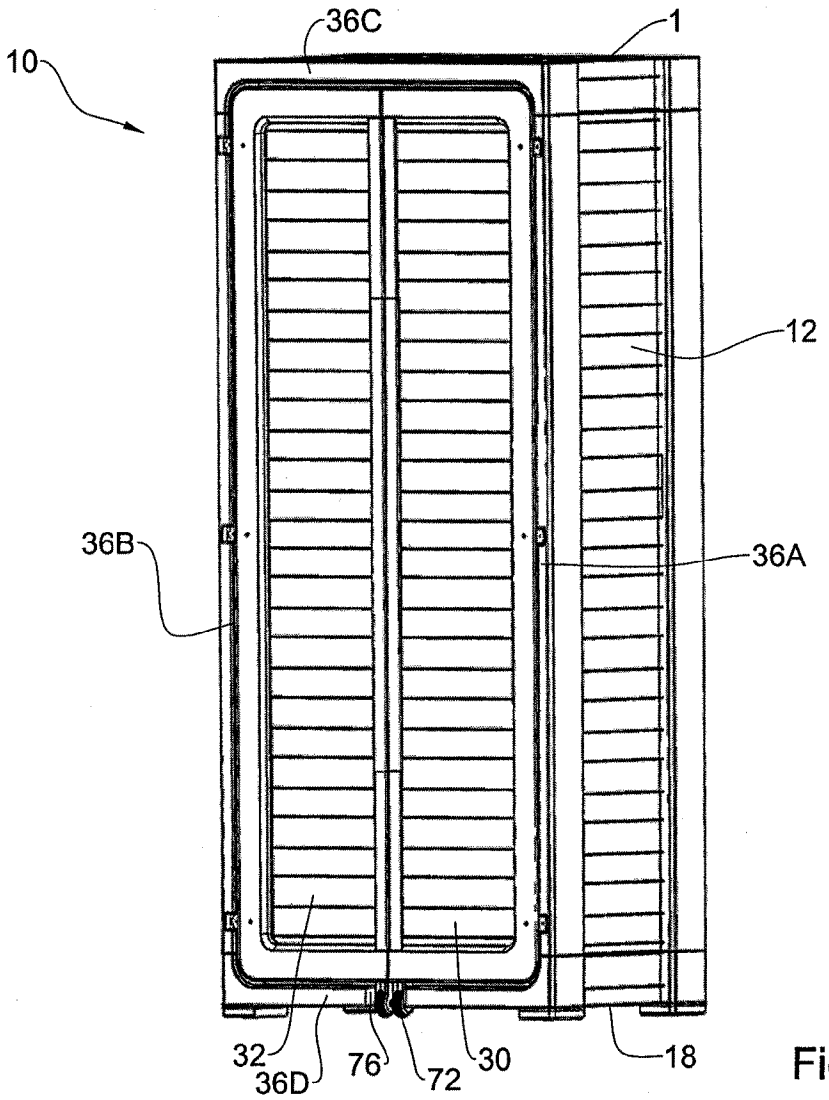
FIG. 1A is a front perspective view of a cabinet according to an example of the present disclosed subject matter.
Figure 1B:
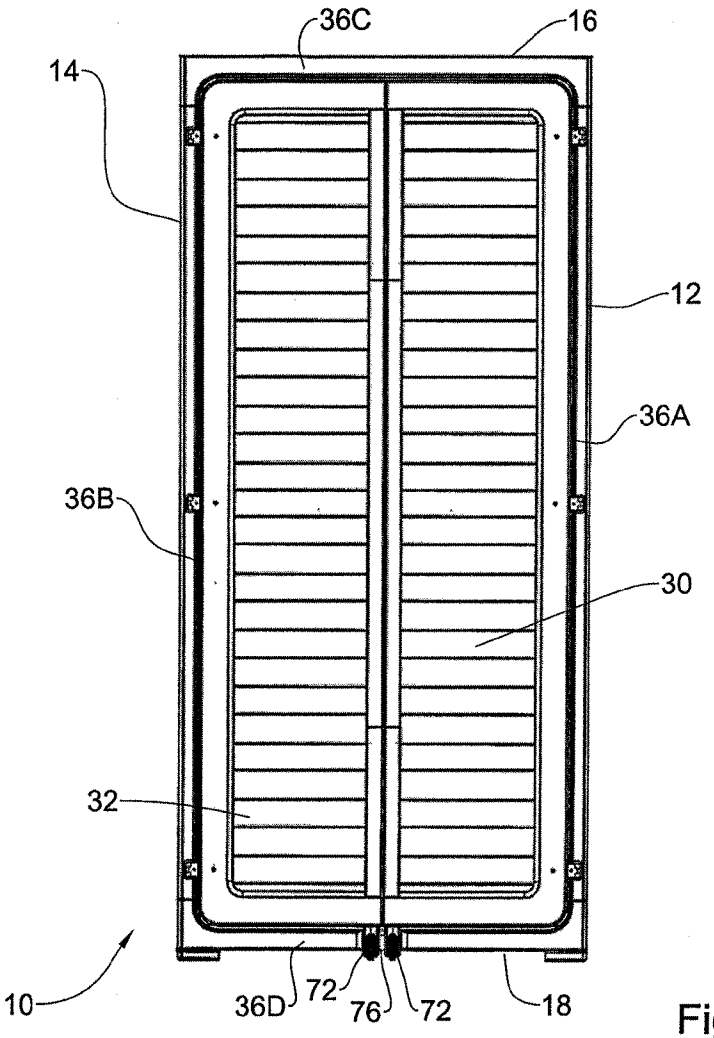
FIGS. 1B and 1C are a front and a side view, respectively, of the cabinet of FIG. 1A.
Figure 1C:
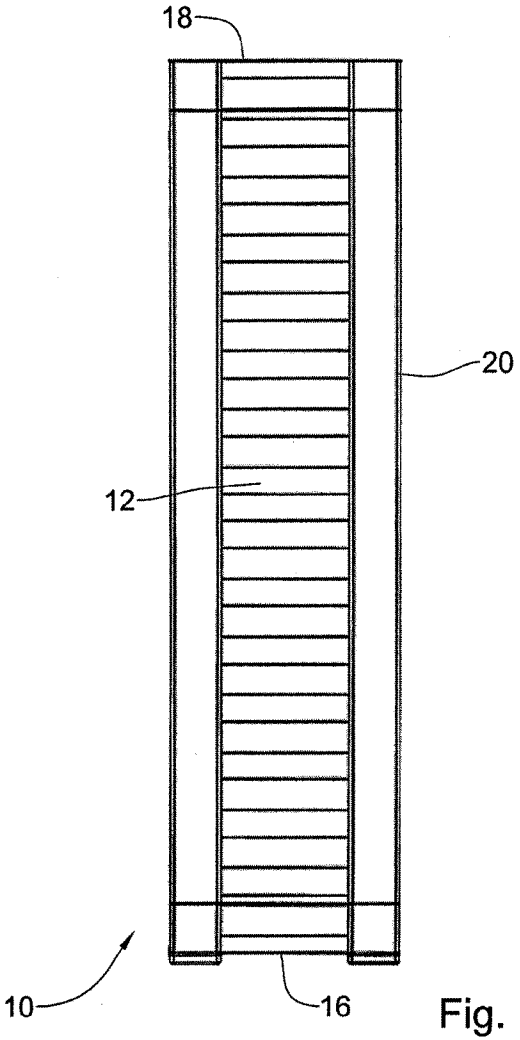
Figure 3A:
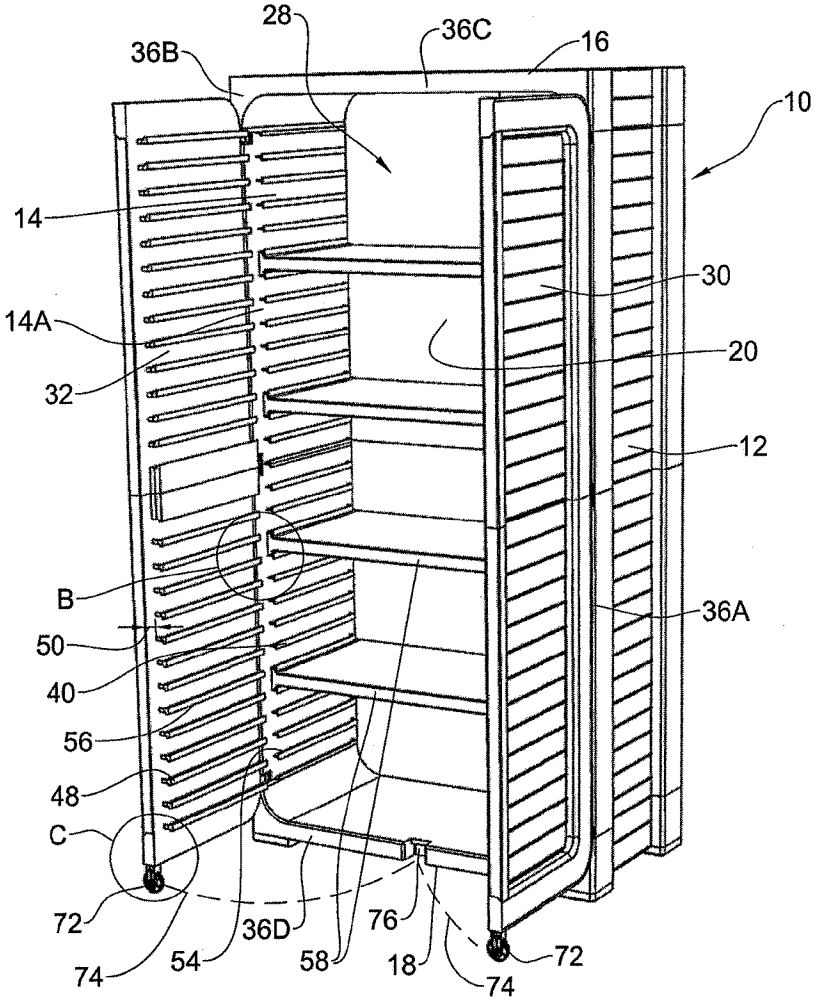
FIG. 3A illustrates the cabinet of FIG. 1 with both front doors open at a first open position, and accommodating several shelves.
Figure 4:
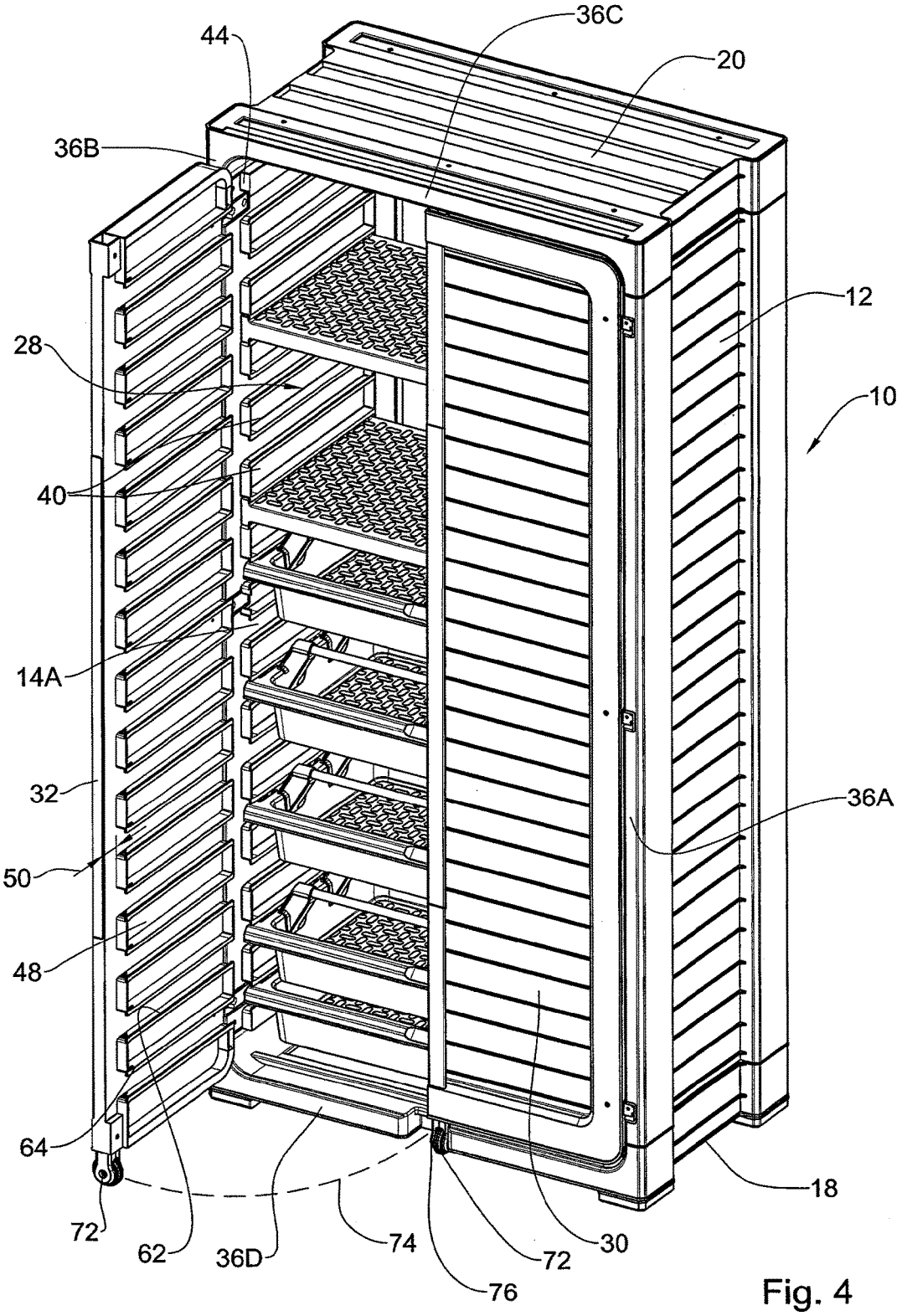
FIG. 4 illustrates the cabinet of FIG. 1 with one front door closed and the other door open at a first open position, and accommodating different support units.

In FIGS. 1A to 1C there is illustrated a tall cabinet generally designated 10 and comprising a right side wall 12, a left side wall 14, a top wall 16, a base 18 and a back wall 20, defining together a cabinet space 28 (FIGS. 3A, 4 and 5). The cabinet 10 is further fitted with a right front door 30 and a left front door 32, said doors being pivotally articulated at a front edge portion of the side walls 12 and 14, respectively.

The cabinet 10 is supported over supports disposed at respective corners thereof, suitable for leveling the cabinet (said supports can be height adjustable according to a modification, not shown), and spacing it from the floor to leaving a small gap, if any. According to an example, the supports may be movably received within the corners of the cabinet (not shown).

The front doors 30 and 32 are pivotal between a closed position (FIGS. 1 and 2), and a first open position where the doors extend substantially co-planner with the respective side walls, i.e. pivoted by 90° (FIGS. 3A, 4 and 5). In FIG. 4 the right front door 30 is at its closed position and the left front 32 door is disposed into the first open position (pivoted about 90°). As seen in the drawings, at their closed position the front doors 30 and 32 are coplanar and substantially flush with a front frame 36 composed of a right front frame 36A, a left front frame 36B, a top front frame 36C and a bottom front frame 36D, established by the respective front edges of the right side wall 12, the left side wall 14, the top wall 16, the base 18.

It is however appreciated that according to other designs (not shown), the front doors can be pivotally secured the side walls over the front frame portions, concealing same.

The present illustrated examples are directed to a cabinet made of injection molded plastic material. It should be noted however, that the cabinet can be made in other technologies and be made of other materials. Even more so, in the presently disclosed examples, the cabinet is composed of two side walls, a top wall, a base and a back wall. However, according to other arrangements (not shown), the cabinet can be a niche cabinet wherein all or one or more of the walls of the cabinet are walls or structure elements of other constructions (e.g. a built-in cabinet or a partially built-in cabinet). Optionally, where one or both of the side walls are structure elements of other constructions, there may be inserted an inside wall plate configured with a plurality of rail segments and mimicking an inside face of the respective side wall (not shown).

The right side wall 12 and the left side wall 14 are each configured at their inside surface 12A and 14A respectively, with a plurality of parallely disposed, opposing, wall rail segments 40, wherein each pair of opposing wall rail segments 40 define together a sliding plane configured for sliding accommodating a support unit, as will be discussed herein.

Figure 7:
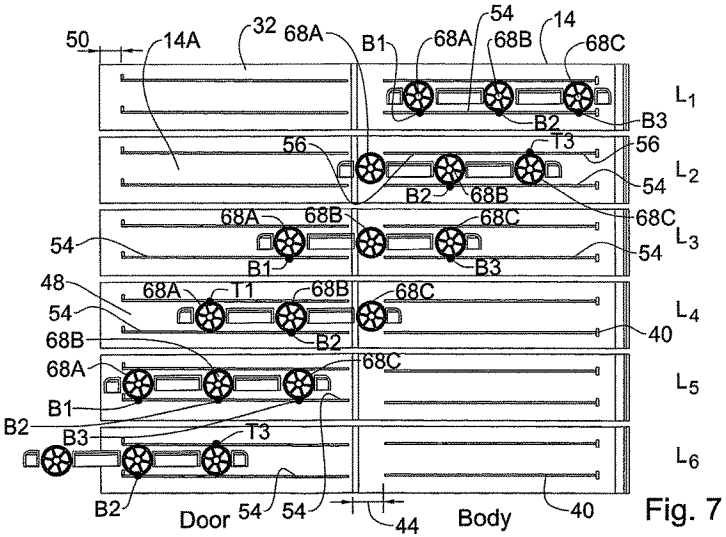
FIG. 7 is a schematic illustration of progressing a support unit over a rail segment.

As noted in the drawings, the wall rail segments extend substantially from the back wall 20 and do not reach the right front frame 36A and the left front frame 36B, but rather leave a gap 44 (best seen in FIG. 7). This enables the disclosed configuration of the front doors 30 and 32, namely extending between the side walls 12 and 14, respectively and flush with the front edge 36 of the cabinet. In particular that is the case noting that the front doors 30 and 32 are configured at their inside with door rail segments 48, the arrangement being such that the wall rail segments 40 are coextensive with respective door rail segments 48, whereby each pair of opposing door rail segments 48 extends coplanar with respective sliding planes between the side walls.

In the particular illustrated example, and as can best be seen in FIG. 7, the door rail segments 48 extend substantially from the hinged edge (i.e. from the edge near the respective side wall), and however at the other end the door rail segments 48 do not reach the mating edge of the front doors, leaving a gap 50.

Figure 8A:
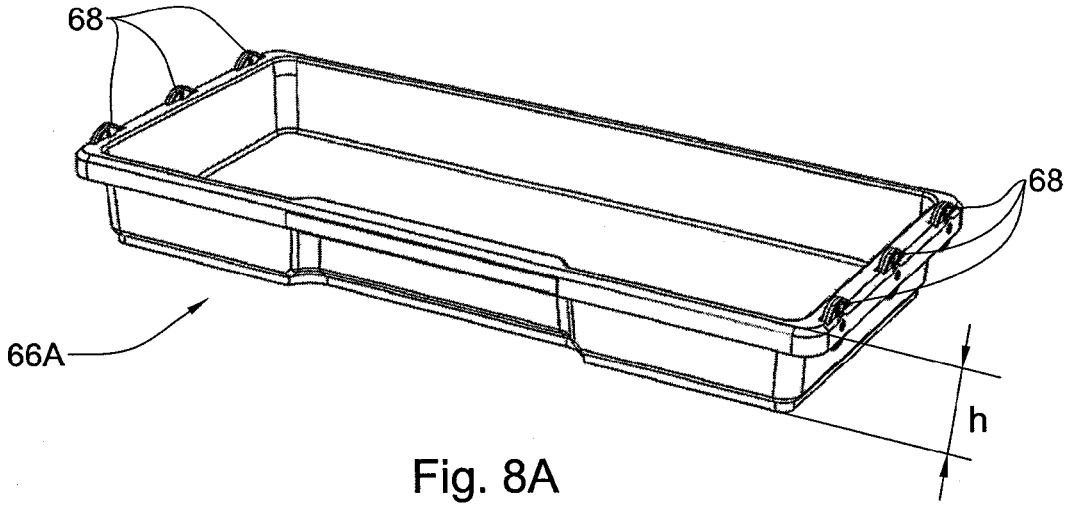
FIGS. 8A to 8C illustrate different examples of support units for use in conjunction with a cabinet according to the present disclosure.
Figure 8B:
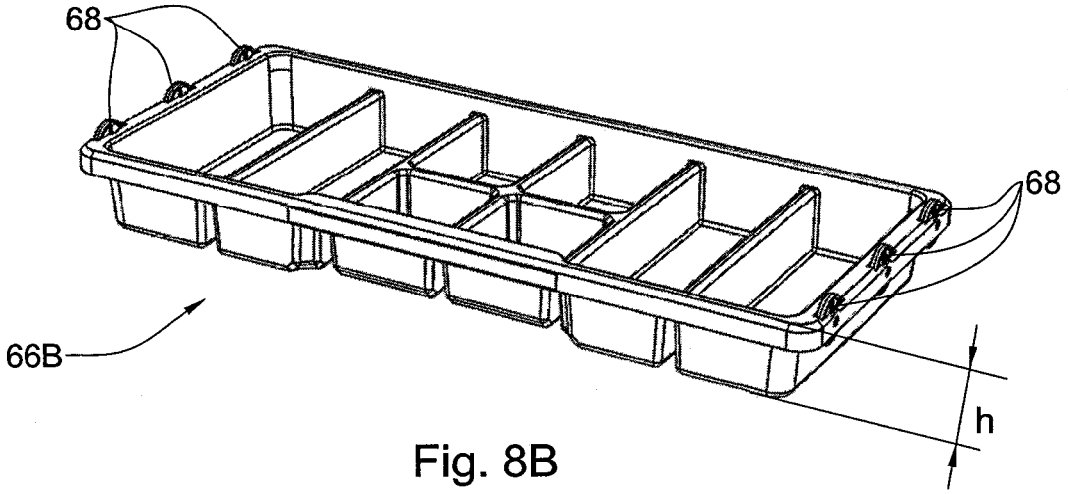
Figure 8C:
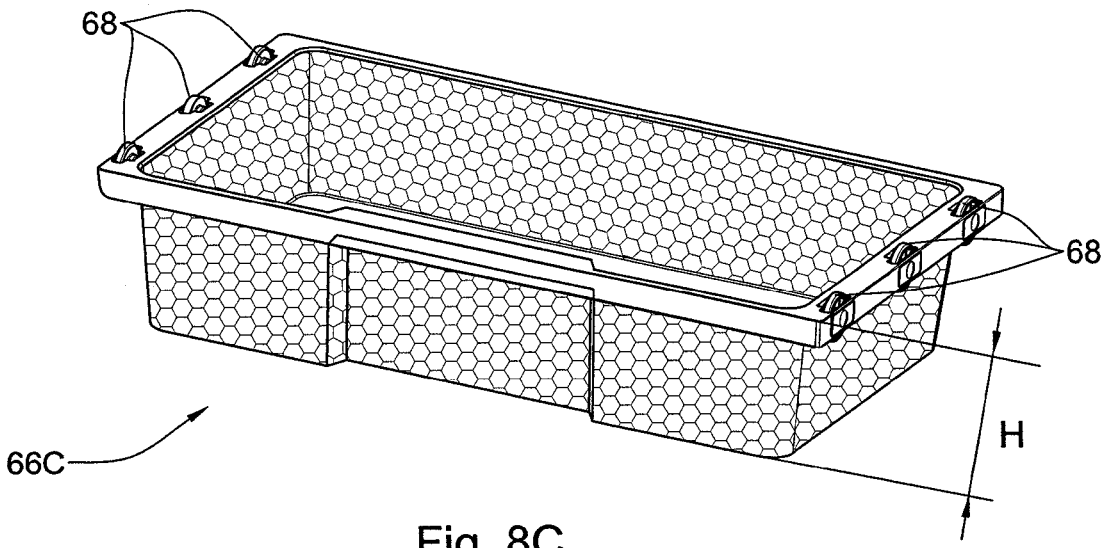

In the illustrated examples the rail segments are disposed about the respective side walls 12 and 14, and about the front doors 30 and 32 at equal intervals, rendering the system suitable for interchangeably receiving a variety of support units, having different heights (FIGS. 8A to 8C).

Figure 3B:
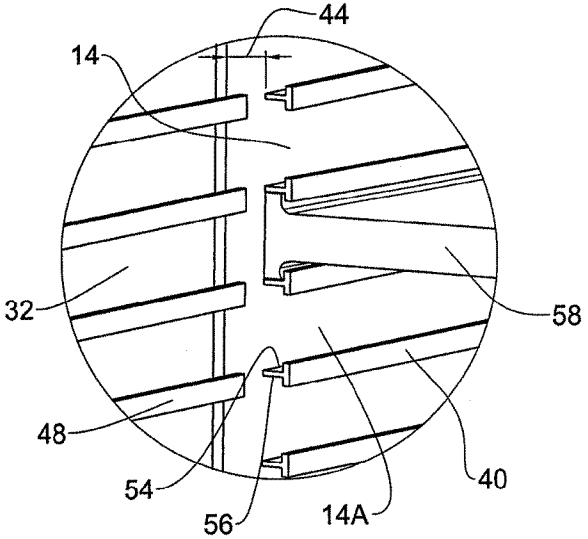
FIG. 3B is an enlargement of the portion marked 'B' in FIG. 3A.
Figure 3C:
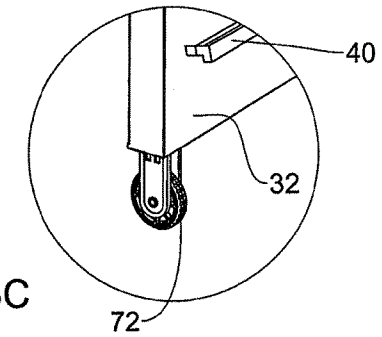
FIG. 3C is an enlargement of the portion marked 'C' in FIG. 3A.

In the illustration of FIGS. 3A and 3B the rail segments have an inverted T-like cross-section, wherein a single rail segment has a top surface 54 serving as a bottom rail segment of one sliding plane, and a bottom surface thereof 56 serving as a top rail segment of another sliding plane extending below said one sliding plane. In the illustrations of FIGS. 3A and 3B the support units 58, shelves in the particular example, have an inverted I-like section configured for sliding between the respective rail segments 54 and 56. It is however appreciated the rollers/wheels can be added, as will be discussed in connection with the following example.

Figure 5A:
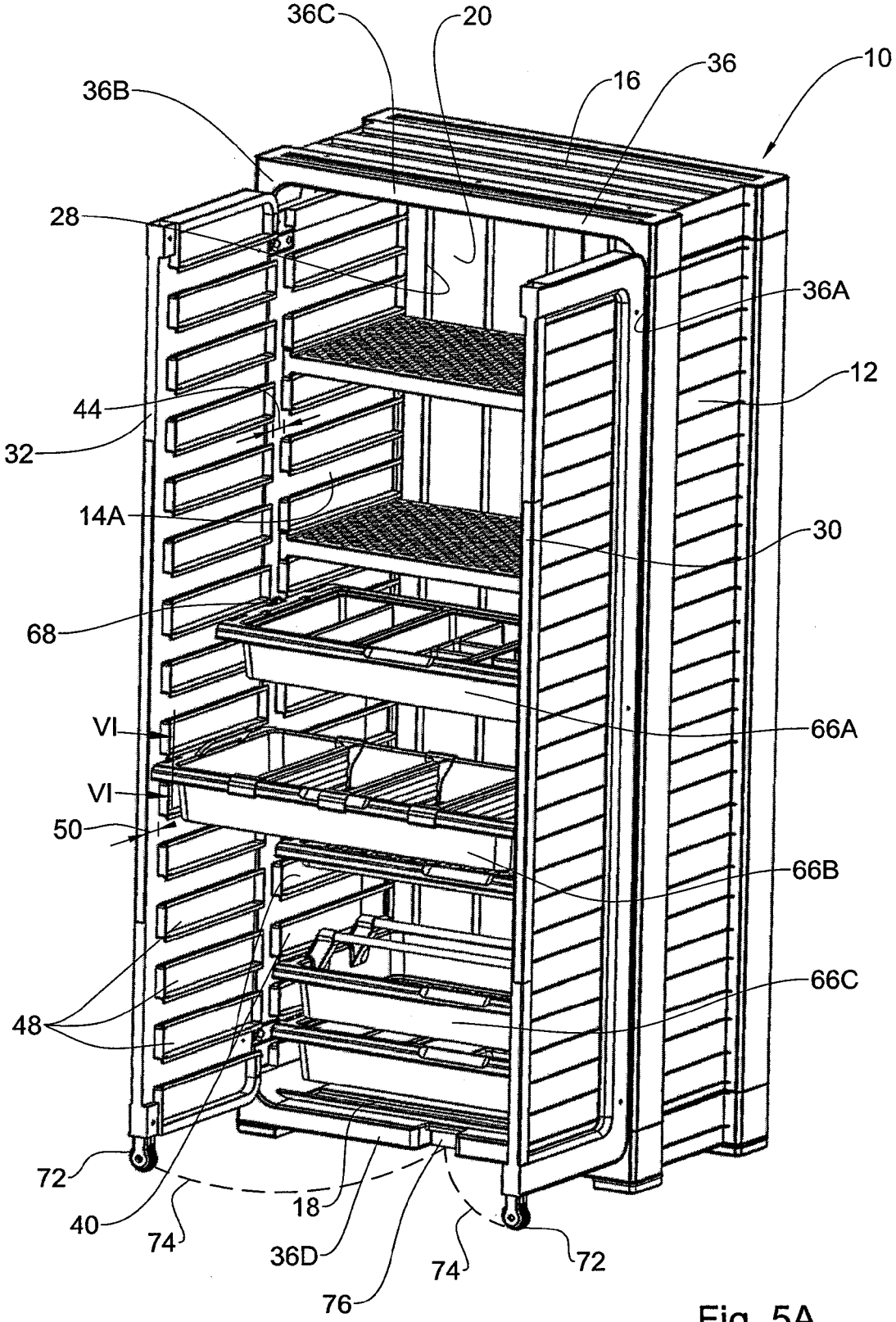
FIGS. 5A and 5B are a right side perspective view and a left side view, respectively, illustrating the cabinet of FIG. 1 with both front doors open at a first open position, and accommodating different support units, each disposed at a different state.
Figure 5B:
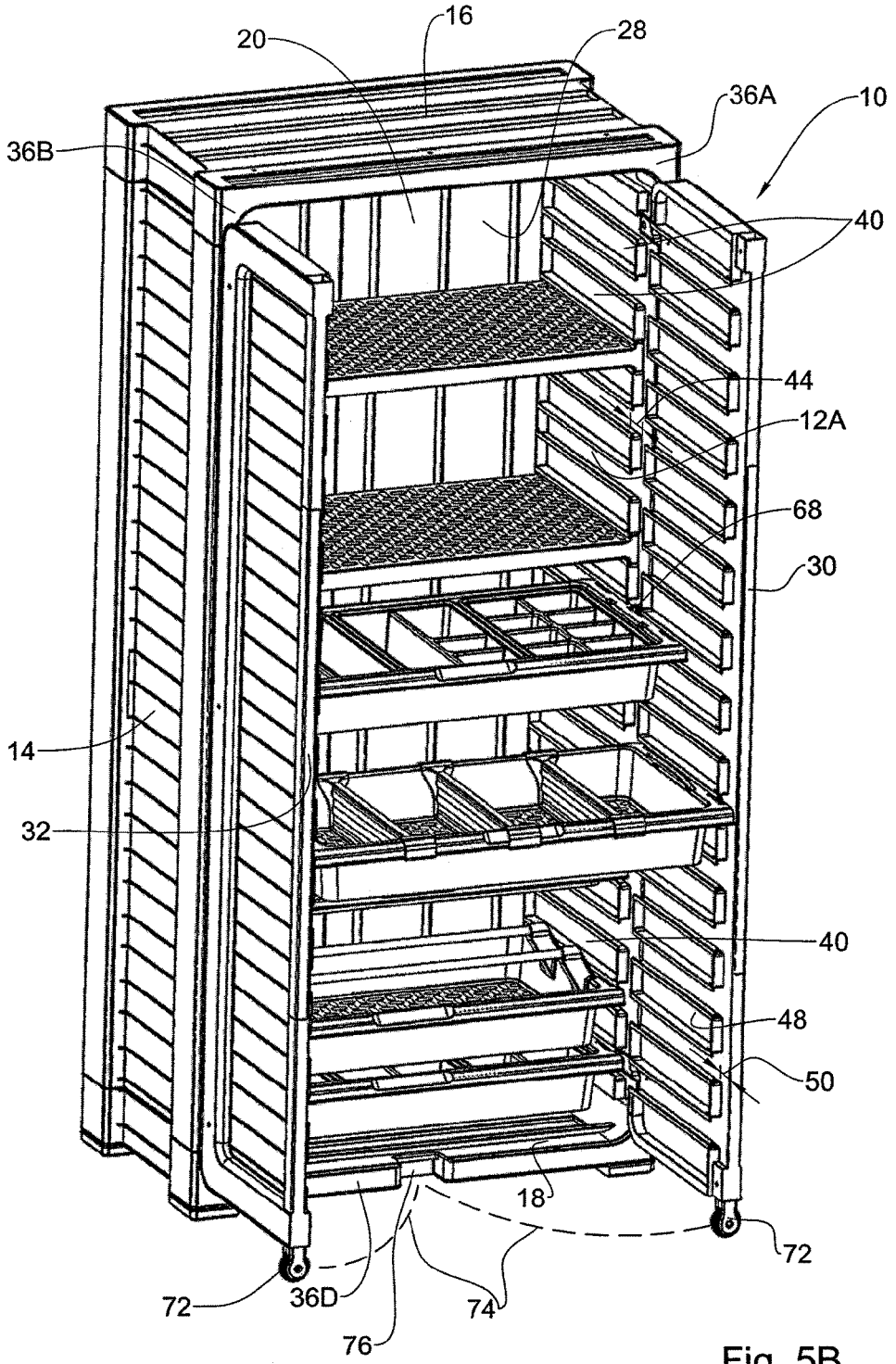
Figure 6A:
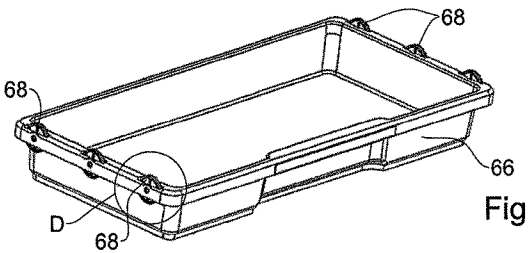
FIG. 6A is an isometric view of a support unit in the form of a drawer, fitted with wheels serving as rail engaging members.
Figure 6B:
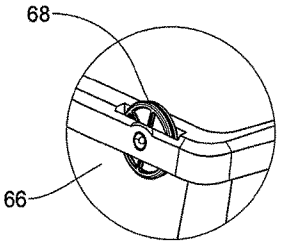
FIG. 6B is an enlargement of the portion marked 'D' in FIG. 6A.
Figure 6C:
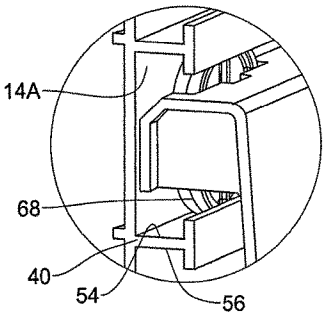
FIG. 6C is an enlarged sectioned portion view taken along line VI-VI in FIG. 5.

In the example illustrated in FIGS. 4, 5A and 5B the rail segments have rigid structure defining a top surface 62 serving as a bottom rail segment of one sliding plane, and a bottom surface thereof 64 serving as a top rail segment of another sliding plane extending below said one sliding plane. In this example the support units 66A, 66B and 66C (baskets of different configurations) are configured with three equi-spaced rail engaging members, namely wheels 68. The shelves 58 are of similar structure as those described in connection with the example of FIGS. 3A and 3B, however are slidingly engaged with the rail segments. It is however appreciated that there may be more than three rail engaging members at each side of the support unit, thereby reducing loads from each such rail engaging member and further, improving stability of the support unit, in particular when it is partially drawn out.

Further noted, the front doors 30 and 32 are fitted at their bottom edge with a floor engaging support, namely caster/swivel wheel 72, configured for rolling over a floor surface about an arced path 74, and supporting the doors at their respective closed and in particular first open position, when one or more support units are extracted from the cabinet space and are now supported by the door rail segments. As can be seen in the drawings, the bottom front edge 36D is configured with a recess 76 for receiving the floor engaging support wheels 72 of the front doors at their closed position, such that the wheels substantially do not project from the bottom front edge 36D. It will be appreciated that the floor engaging wheels of the front door can be configured for height adjustment. In accordance with another example the floor engaging wheels are detachably attachable members.

The support units are displaceable between a fully retracted position and an extracted position. At the fully retracted position (e.g. as seen in FIGS. 1A, 1B, 1C, 3A, 4, 12A), and schematically represented at level $L_1$ in FIGS. 7, and level $E_1$ in FIGS. 12B and 12C, wherein the support units are fully received within the cabinet space 28. At this position the loads are born by a top surface 54 of the wall rail segment 40, at reaction to wheel engagement locations $B_1$, $B_2$ and $B_3$ (corresponding with wheels 68A, 68B and 68C, respectively). At the extracted position (FIGS. 5A, 5B, 12B and 12C), schematically represented at level $L_5$ in FIG. 7 and level $E_3$ in FIGS. 12B and 12C, the support units are completely out of the cabinet space 28, however supported between the front doors 30 and 32. At the fully extracted position the three rail engaging wheels 68 at each side of the support units bear over the respective door rail segments 48 of the sliding plane. At this position the loads are born by a top surface 54 of the door rail segment 48, at reaction to wheel engagement locations $B_1$, $B_2$ and $B_3$ (corresponding with wheels 68A, 68B and 68C, respectively).

With particular reference now being made to FIG. 7 of the drawings, it is appreciated that the arrangement is such that at a first extracting sequence of drawing a support unit (level $L_2$), a front rail engaging wheel 68A extends at the sliding gap 44, the center rail engaging member 68B bears at $B_2$ over the top surface 54 of support rail 40 and rear rail engaging member 68C bears at $T_3$ under top surface 56 of support rail 40, such that loads are born by both top and bottom wall rail segments, respectively.

At a next extracting sequence of drawing a support unit (level $L_3$), the front rail engaging wheel 68A bears at $B_1$ over a top surface 54 of the door rail segment 48, the center rail engaging wheel 68B extends at the door rail gap 44, and at the rear rail engaging member 68C bears at $B_3$ over a top surface 54 of the door rail segment 40. Thus, loads are born by the door rail segment and the wall rail segment.

At a further intermediate extracting sequence of drawing a support unit (level $L_4$), the front rail engaging wheel 68A bears at $T_1$ under a bottom surface 56 of the door 30 rail segment 48, the center rail engaging wheel 68B bears at $B_2$ over a top surface 54 of the door rail segment 48, and the rear rail engaging wheel 68C extends at the door rail gap 44. Thus, at this position loads are born substantially by the top and bottom door rail segment.

Upon further extracting the support unit to a position where a front rail engaging member extends out of the rail segments and is now fully supported only over the door rail segments (level $L_5$), the loads are born by a top surface 54 of the door rail segment 40, at reaction to wheel engagement locations $B_1$, $B_2$ and $B_3$ (corresponding with wheels 68A, 68B and 68C, respectively).

Further extracting the support unit, so that it partially projects from the doors (level $L_6$) results in that the front rail engaging wheel 68A extends at or over the gap 50, the center rail engaging member 68B bears at $B_2$ over the top surface 54 of door support rail 48 and rear rail engaging member 68C bears at $T_3$ under top surface 56 of door support rail 48, such that loads are born by both top and bottom door rail segments, respectively.

It is thus noted that at each of the drawing positions at least two rail engaging wheels are in contact with rail segments, imparting it stability and retaining it a level state.

The support units can be full drawn out of the cabinet and returned, and a stopping arrangement (not shown) can be provided to prevent unintentional complete removal of a support unit.

Figures 12A, 12B, 12C:
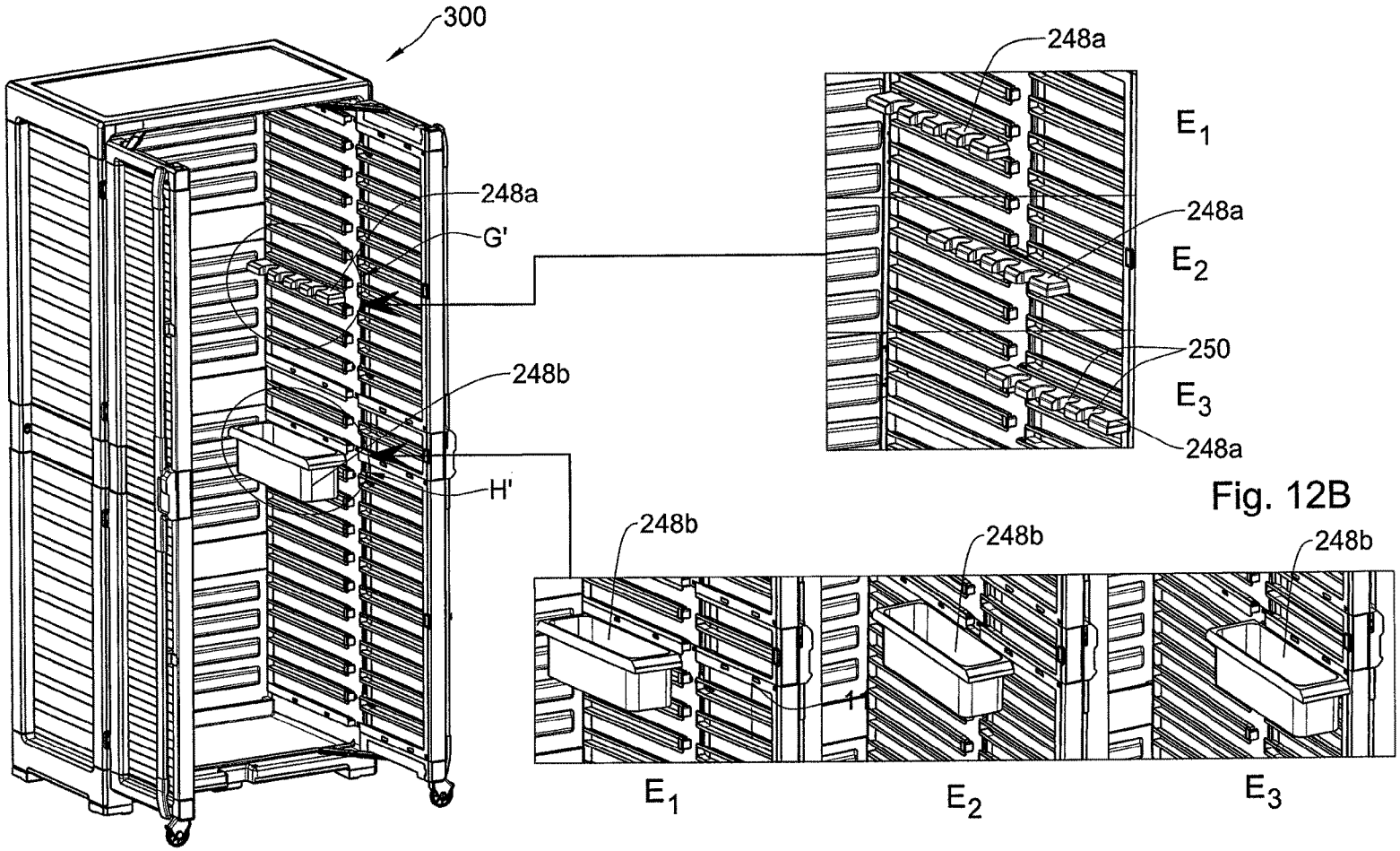
FIG. 12A illustrates different examples of support units for use in conjunction with a cabinet according to the present disclosure.
FIG. 12B and FIG. 12C are enlargements of the portions marked 'G' and 'H' in FIG. 12A, schematically illustrating progressing a support unit over a rail segment.

As already mentioned in connection with FIGS. 8A to 8C, the support units 66A, 66B and 66C respectively, are mere examples of different trays/baskets suitable for use in conjunction with a cabinet according to the present disclosure. However, a noticeable difference between the support units 66A, 66B and 66C is that support unit 66C has a height H being twice the height h of support units 66A and 66B. This configuration is possible owing to the equal space between rail segments of the cabinet. Yet an example of the support units is illustrated in FIG. 12A in which the support units 248*a* is a tool rack and the support unit 248*b* is a basket like drawer, both being configured for engagement with the wall and door rail segments of the cabinet 300 at their one side. The support unit 248*b* is a narrow basket such that it is suitable to engage the rail segments only on one side thereof and to retain itself at a substantially level state. This is achieved for example by the narrow dimensions of the unit 248*b*. The tool rack 248*a* is configured for holding tools through its engaging members 250 adapted to receive and hold various tools, such as a hammer, a screwdriver, etc. it should be appreciated that other types of utility tools can be engaged by the tool rack, which in other examples can be a clothes hanger, holder for brooms, etc.

Figure 2:
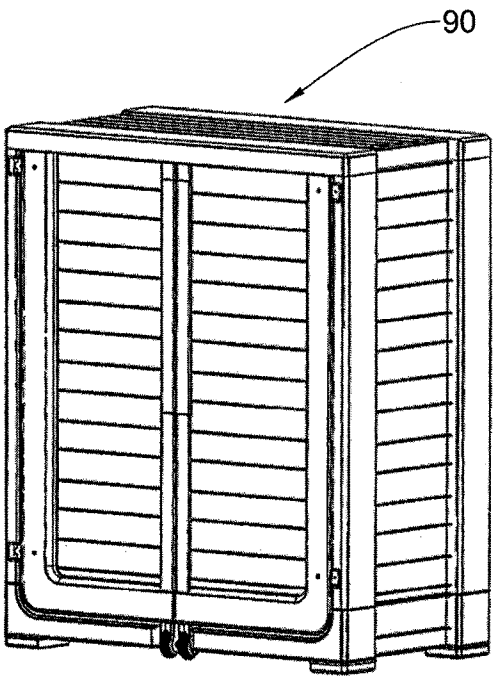
FIG. 2 is a front perspective view of a short cabinet according to another example of the present disclosed subject matter.

FIG. 2 is yet an example of a cabinet 90 according to the present disclosed subject matter, however wherein the overall size of the cabinet 90 is about half the height of the cabinet 10 in the previous examples. Apart for different size, all other features are as previously discussed hereinbefore, mutatis mutandis.

Figure 9:
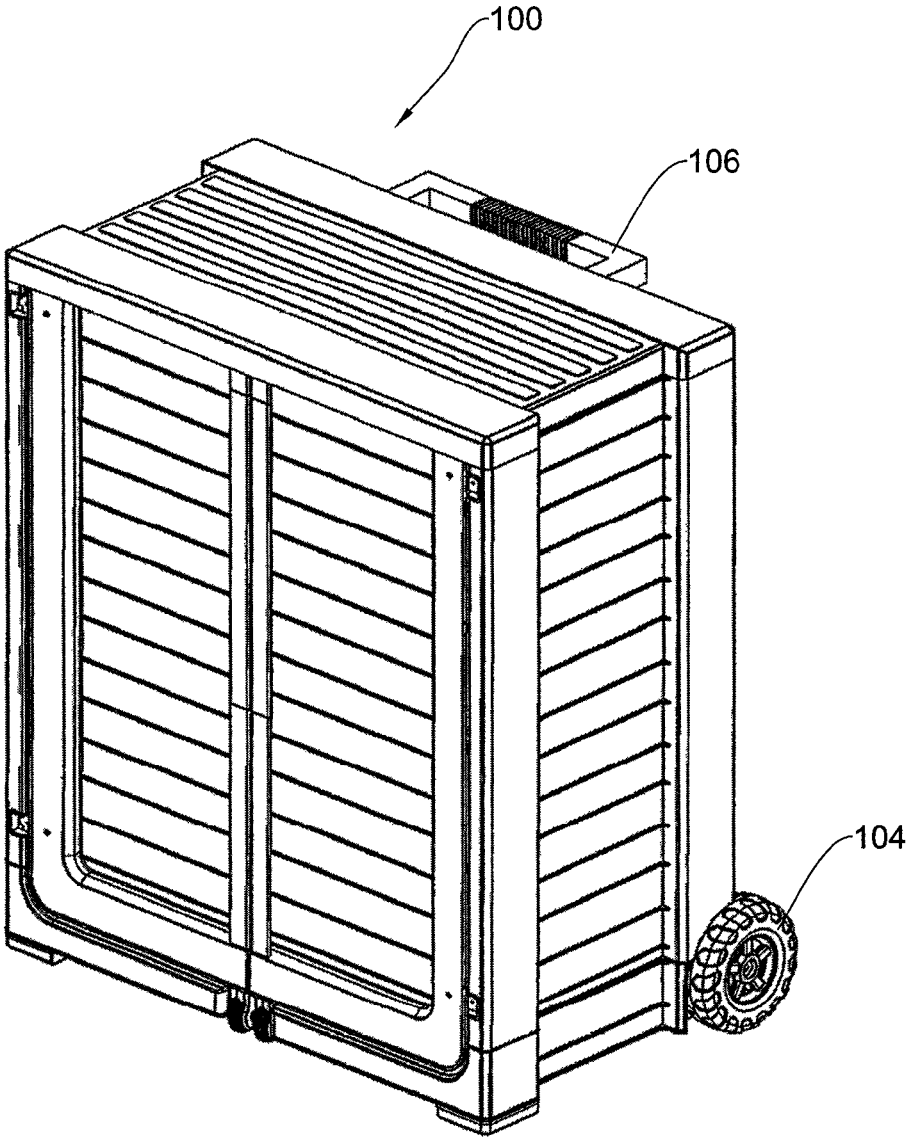
FIG. 9 is an example of a cabinet according to the present disclosure, configured as a carry along trolley.
Figure 10B:
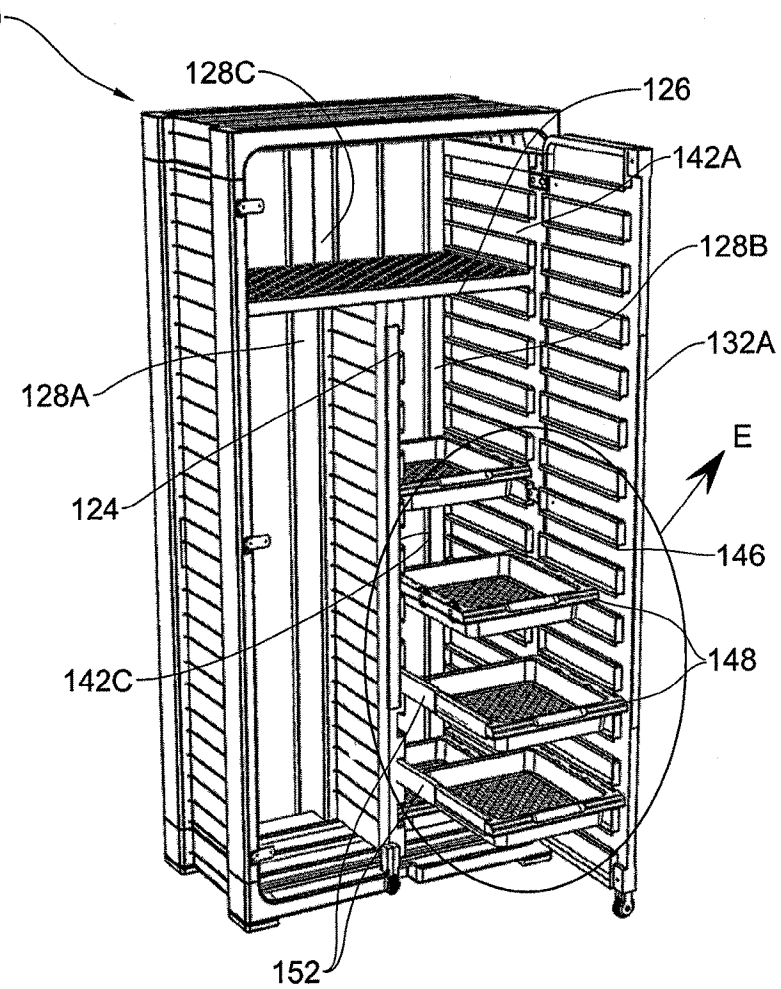
Figure 10A:
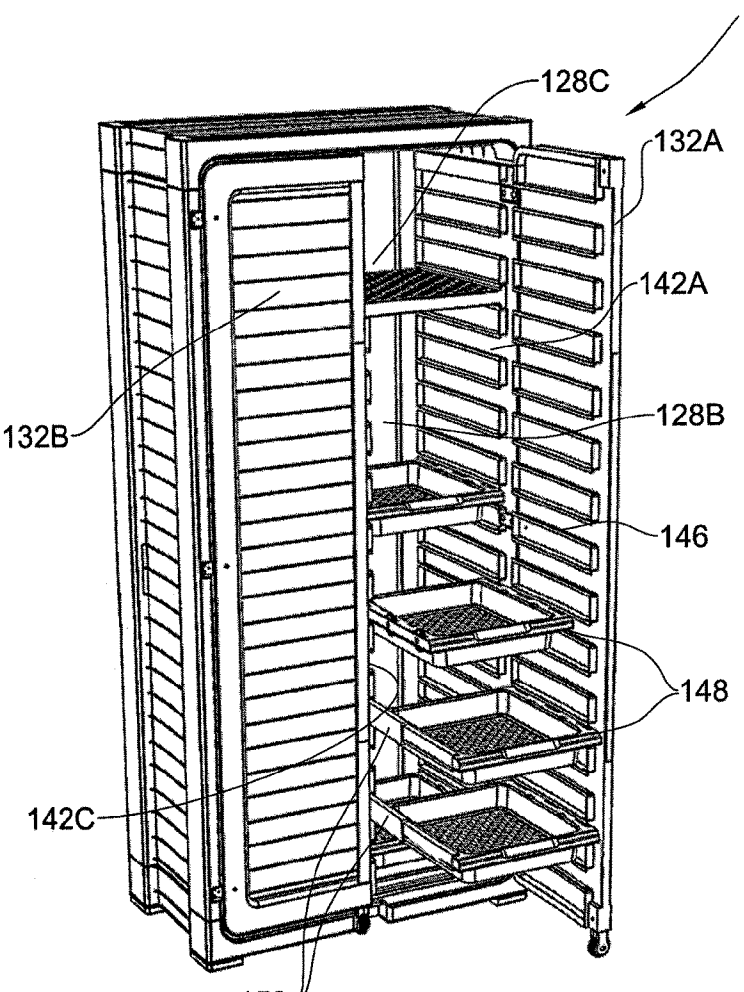
Figure 10E:
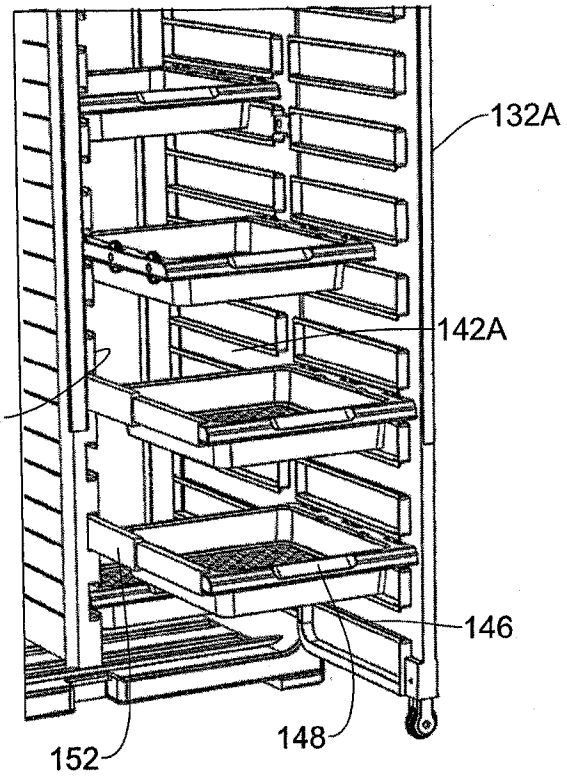
Figure 10D:
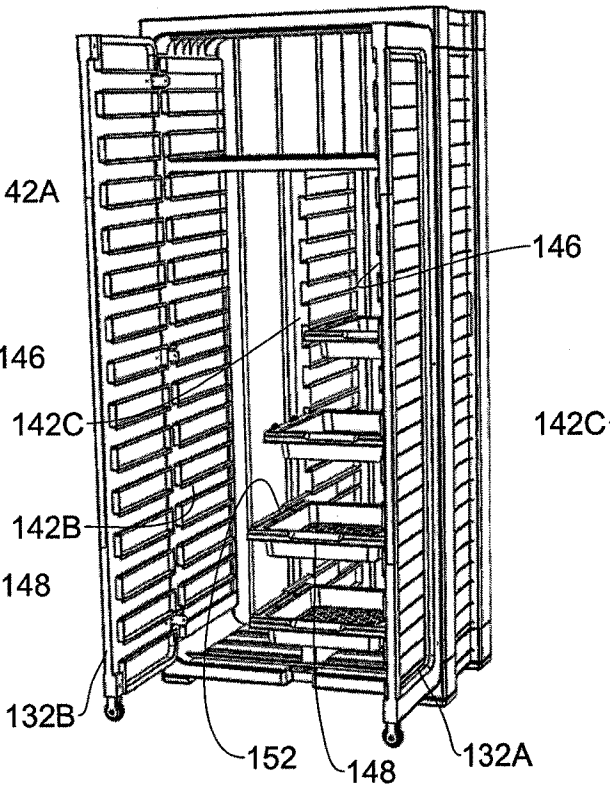
Figure 10C:
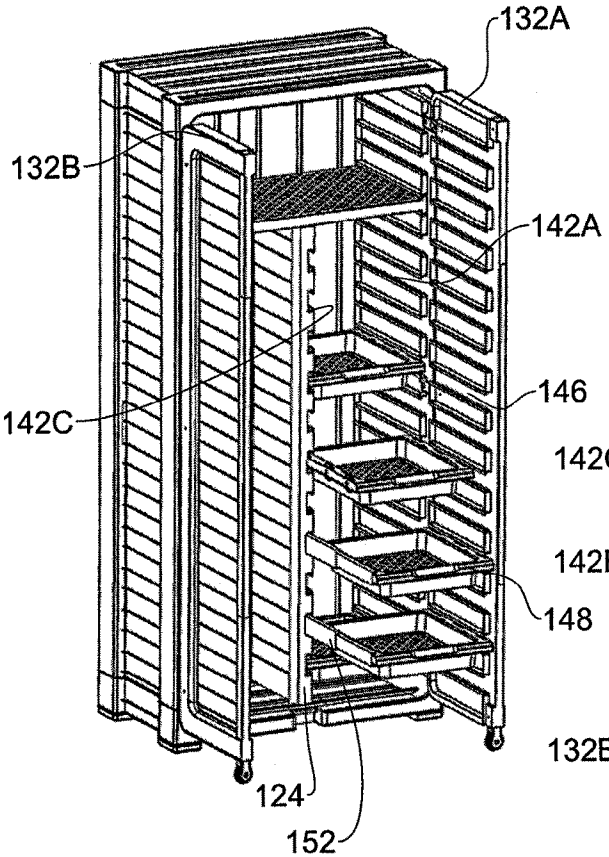
Figure 11:
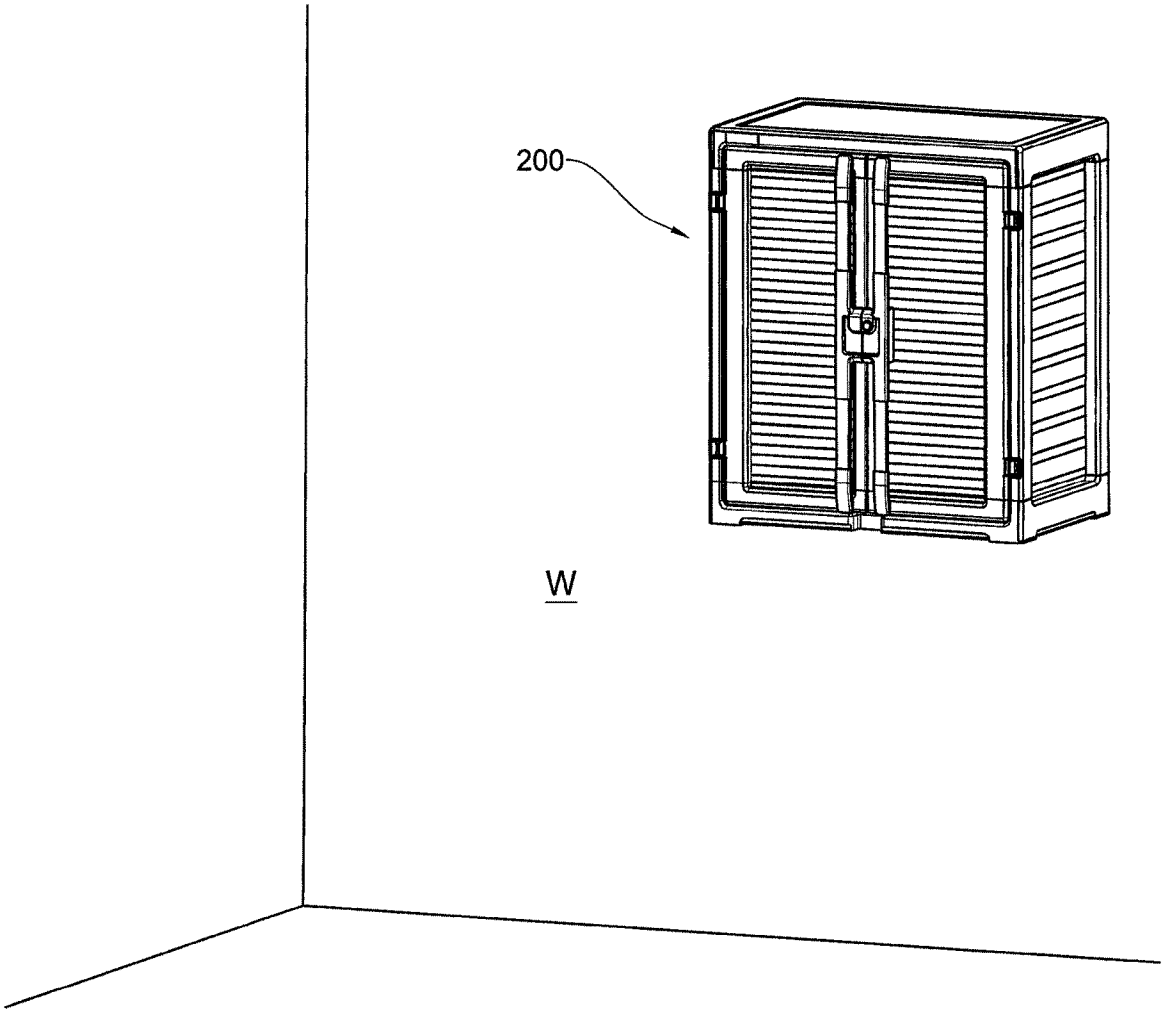
FIG. 11 is an example of a cabinet according to the present disclosure, configured for mounting over a wall.

FIG. 9 of the drawings illustrates a cabinet generally designated 100, similar in size to cabinet 90 of FIG. 2, however configured with a pair of wheels 104 at a rear bottom portion, and a handle 106 at a rear top portion, whereby the cabinet 100 can be tilted and locomoted over the wheels 104. Apart for the locomotion arrangement, all other features are as previously discussed hereinbefore, mutatis mutandis. FIG. 11 illustrates a cabinet generally designated 200, similar in size to cabinet 90 and 100 of FIGS. 2 and 9, however configured with mounting members at its back side (not seen) for mounting the cabinet on a wall W. Apart for the mounting arrangement, all other features are as previously discussed hereinbefore, mutatis mutandis. It will be appreciated that the cabinets 90 and 100 can be adapted for mounting, e.g. by having the rear wheels 104 either detachably attachable or received within the rear and bottom wall so as not to protrude outwards when mounted.

With further reference to FIGS. 10A to 10E of the drawings, there is illustrated a cabinet according to another example of the disclosed subject matter generally designated 120.

The cabinet 120 is substantially similar to the previous disclosure herein above, however, with the provision of a vertical partition wall 124 extending up to a shelf 126 (fixed in the present example, though according to other example can be removable), thereby dividing the cabinet space into three partitions 128A, 128B and 128C. The cabinet 120 is configured with two front doors 132A and 132B, both extending the entire height of the cabinet.

The arrangement is such that both the side walls of the cabinet are configured with wall rail segments 142A and 142B (the later seen only in FIG. 10D), and likewise at least one side of the partition wall 124 is configured with partition wall rail segments 142C. In the particular example partition wall rail segments are configured only at the right face of the partition wall 124, i.e. facing wall rail segments 142A and defining together respective sliding planes.

It is appreciated that the at least the right front door 132A is configured with door rail segments 146, coextending with wall rail segments 142A, as discussed herein above.

Support units 148 are disposed within the right partition 128B, slidingly retained between the wall rail segments 142A and the partition wall rail segments 142C and further over the door rail segments 146. However, in order to support the support units 148 at the retracted position, the support units 148 are supported at their partion wall facing side over a telescopic rail 152 (best seen in FIG. 10E).

Whilst not illustrated in the Figs., the top partition 128C could accommodate one or more support units slidingly disposed between the two side walls of the cabinet, and likewise, additional support units can be configured at the partition 128A.

Whilst in the annexed drawings there are illustrated cabinets configured with two doors, namely a right front door 30 and a left front door 32, it should be appreciated that the cabinet can be configured with one door only, or alternatively with more than two doors, mutatis mutandis.

The invention claimed is:

1. A cabinet, comprising:

a right side wall;

a left side wall;

a top wall;

a bottom wall; and a back wall;

wherein the right side wall, the left side wall, the top wall, the bottom wall, and the back wall together define a cabinet space, which is closeable by at least one front door pivotally articulated at a front portion of the cabinet and displaceable between a closed position and at least a first open position, wherein, at said first open position, the at least one front door is substantially coplanar with a respective side wall;

wherein one or both of the right side wall and the left side wall are configured with wall rail segments;

wherein the at least one door is configured with door rail segments, such that the wall rail segments are substantially coextensive with respective door rail segments, with a sliding gap extending between neighboring ends of a wall rail segment and a door rail segment, and defining together one or more sliding planes each configured for slidingly supporting a support unit mounted thereon;

wherein the support unit includes at least three rail engaging members at least at one mounting side thereof, the rail engaging members being receivable in the respective rail segment in a sliding engagement;

wherein the support unit is displaceable between a fully retracted position, at least one intermediate position, and an extracted position;

wherein the wall rail segments and the door rail segments are substantially parallely disposed at a substantially equidistanced configuration;

wherein the rail engaging members are configured to be supported by a bottom rail segment or both a top and bottom rail segment, depending on a displacement location of the rail engaging members with respect to the sliding gap such that at least two of the rail engaging members are configured to be alternatingly supported by the bottom rail segment or by both the top and bottom rail segments, and remain engaged with the bottom or both of top and bottom rail segments; upon displacement of the support unit; and at least one of the wall rail segments or the door rail segments is integrally formed with the respective side walls and the at least one front door.

2. The cabinet according to claim 1, wherein said plurality of rail engaging members include more than three rail engaging members at each side of the support unit.

3. The cabinet according to claim 1, wherein the at least one door includes a floor engaging support.

4. The cabinet according to claim 3, wherein the floor engaging support is configured near or at an innermost location of the at least one door.

5. The cabinet according to claim 3, wherein a front edge of the bottom wall is configured with a recess for receiving the floor engaging support of the at least one door at the closed position.

6. The cabinet according to claim 1, further comprising a locomoting system.

7. The cabinet according to claim 6, wherein the locomoting system includes a rear wheeling system disposed at or near a rear portion of the cabinet, and a manipulating mechanism for tilting and wheeling the cabinet over the rear wheeling system.

8. The cabinet according to claim 1, wherein the rail engaging members are friction reducing element facilitating stabilized support yet smooth displacement of a support unit over the rail segments.

9. The cabinet according to claim 1, wherein the cabinet includes two or more doors, where two opposing doors extending from side walls of the cabinet are configured with door rail segments such that at the open position they coextend the sliding planes defined by the rail segments.

10. The cabinet according to claim 1, wherein a single rail segment can have a top surface serving as a bottom rail segment of one sliding plane, and a bottom surface serving as a top rail segment of another sliding plane extending below said one sliding plane.

11. The cabinet according to claim 1, wherein the support unit can extend between one side wall and respective door unit of the cabinet, and a fixed partition wall of the cabinet, wherein the fixed partition wall is fitted with a co-planar optional telescopic rail configured for supporting the support unit.

12. A cabinet, comprising:

at least a right side wall and a left side wall, defining together a cabinet space, closeable by at least one front door pivotally articulated at a front portion of the cabinet and displaceable between a closed position and at least a first open position;

wherein at said first open position, the at least one door is substantially coplanar with a respective side wall;

wherein at least one of the right side wall or the left side wall is integrally formed with wall rail segments; and wherein the at least one front door is integrally formed with door rail segments, such that the wall rail segments are substantially coextensive with respective door rail segments at said first open position, with a sliding gap extending between neighboring ends of a wall rail segment and a door rail segment, and defining together one or more gapped sliding planes, each configured for slidingly receiving a support unit that comprises at least three rail engaging members at at least one mounting side of the support unit, such that either bottom rail segments or both bottom and top rail segments alternatingly support the rail engagement members and remain engaged with at least two of the rail engaging members at each location of the rail engaging members along the gapped sliding plane.

* * * * *